US006109437A

United States Patent [19]

Chao

[11] Patent Number: 6,109,437

[45] Date of Patent: Aug. 29, 2000

[54] TOOL BOX

[76] Inventor: Po-Wen Chao, 58, Ma Yuan West St., Taichung, Taiwan

[21] Appl. No.: 09/436,954

[22] Filed: Nov. 6, 1999

[51] Int. Cl.[7] ..... B65D 85/02

[52] U.S. Cl. ..... 206/378; 206/303

[58] Field of Search ..... 206/303, 372–375, 206/378, 446; 211/70.6; 312/902

[56] References Cited

U.S. PATENT DOCUMENTS

| | | | |
|---|---|---|---|
| 3,726,393 | 4/1973 | Thompson | 206/378 |
| 4,938,355 | 7/1990 | Rocco | 206/372 |
| 4,987,998 | 1/1991 | Tsai | 206/378 |
| 5,398,823 | 3/1995 | Anders | 206/378 |
| 5,484,057 | 1/1996 | Tzu-Ching | 206/378 |
| 5,573,116 | 11/1996 | Zink | 206/378 |
| 5,826,719 | 10/1998 | Chen | 206/373 |
| 5,839,579 | 11/1998 | Lee | 206/378 |
| 5,988,382 | 11/1999 | Ritchie et al. | 206/372 |

*Primary Examiner*—Jim Foster

[57] ABSTRACT

A tool box has a lower casing and an upper casing engaging with the lower casing. The lower casing has a plurality of separation plates, and at least a series of spaced grooves defined between two of the separation plates. Each of the separation plates has a plurality of click blocks and a plurality of click protrusions. A plurality of sleeves are inserted in the spaced grooves. Each of the sleeves has a center hole engaging with the respective click block and the respective click protrusion.

1 Claim, 6 Drawing Sheets

TOOL BOX

BACKGROUND OF THE INVENTION

The present invention relates to a tool box. More particularly, the present invention relates to a tool box which can receive a plurality of sleeves stably.

Referring to FIGS. 1 and 2, a conventional tool box has a lower casing 10 and an upper casing 101 engaging with the lower casing 10. The lower casing 10 has a plurality of separation blocks 12 defining a plurality of semicircular grooves 11. Each of the semicircular grooves 11 receive a sleeve 20. Each of the separation blocks 12 has a click bar 13 confining an outer periphery of the respective sleeve 20.

SUMMARY OF THE INVENTION

An object of the present invention is to provide a tool box which can receive a plurality of sleeves stably.

Accordingly, a tool box comprises a lower casing and an upper casing engaging with the lower casing. The lower casing comprises a plurality of separation plates, and at least a series of spaced grooves defined between two of the separation plates. Each of the separation plates has a plurality of click blocks and a plurality of click protrusions.

DETAILED DESCRIPTION OF THE INVENTION

Figure 1:
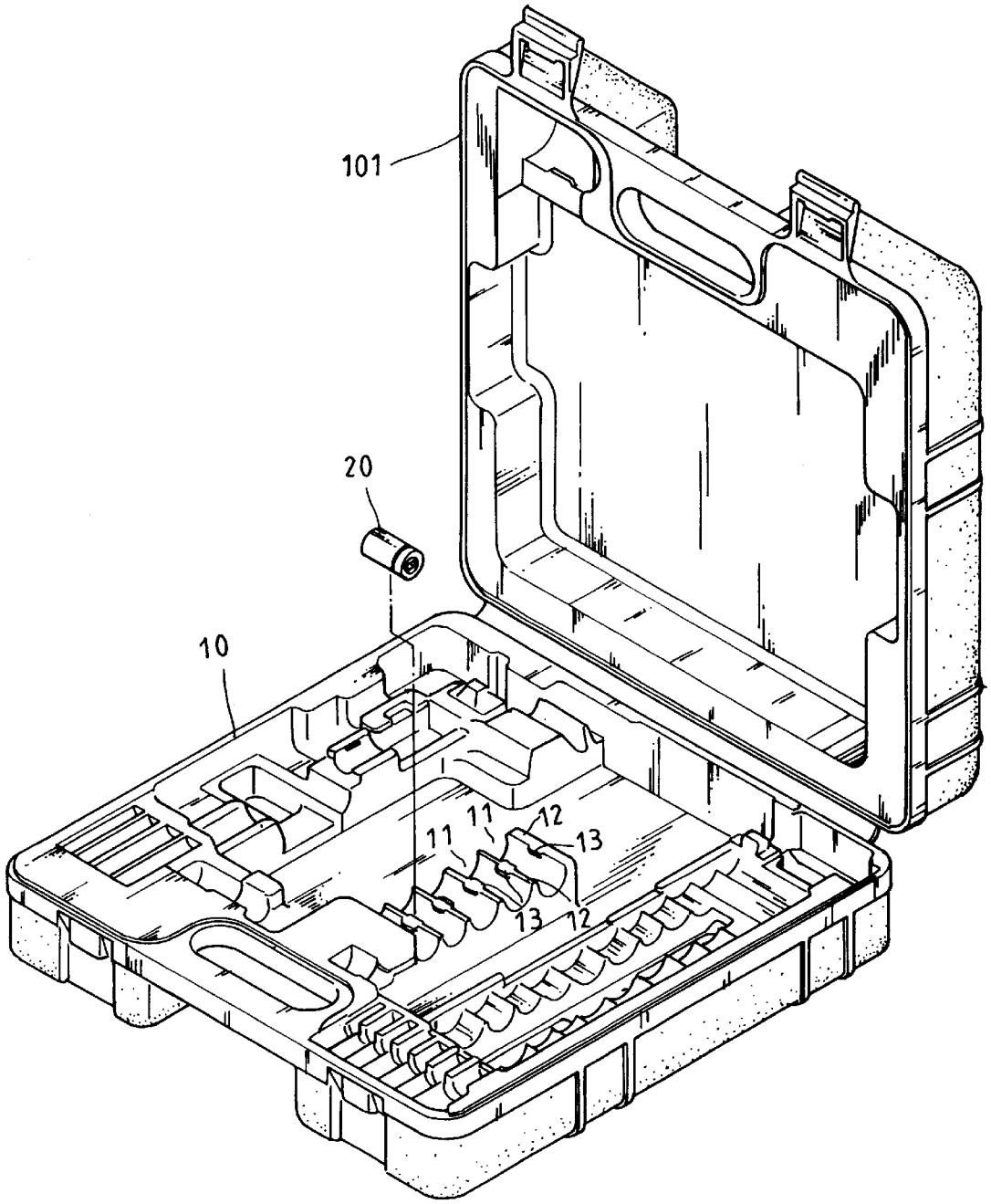
FIG. 1 PRIOR ART
FIG. 1 is a perspective view of a conventional tool box of the prior art.
Figure 2:
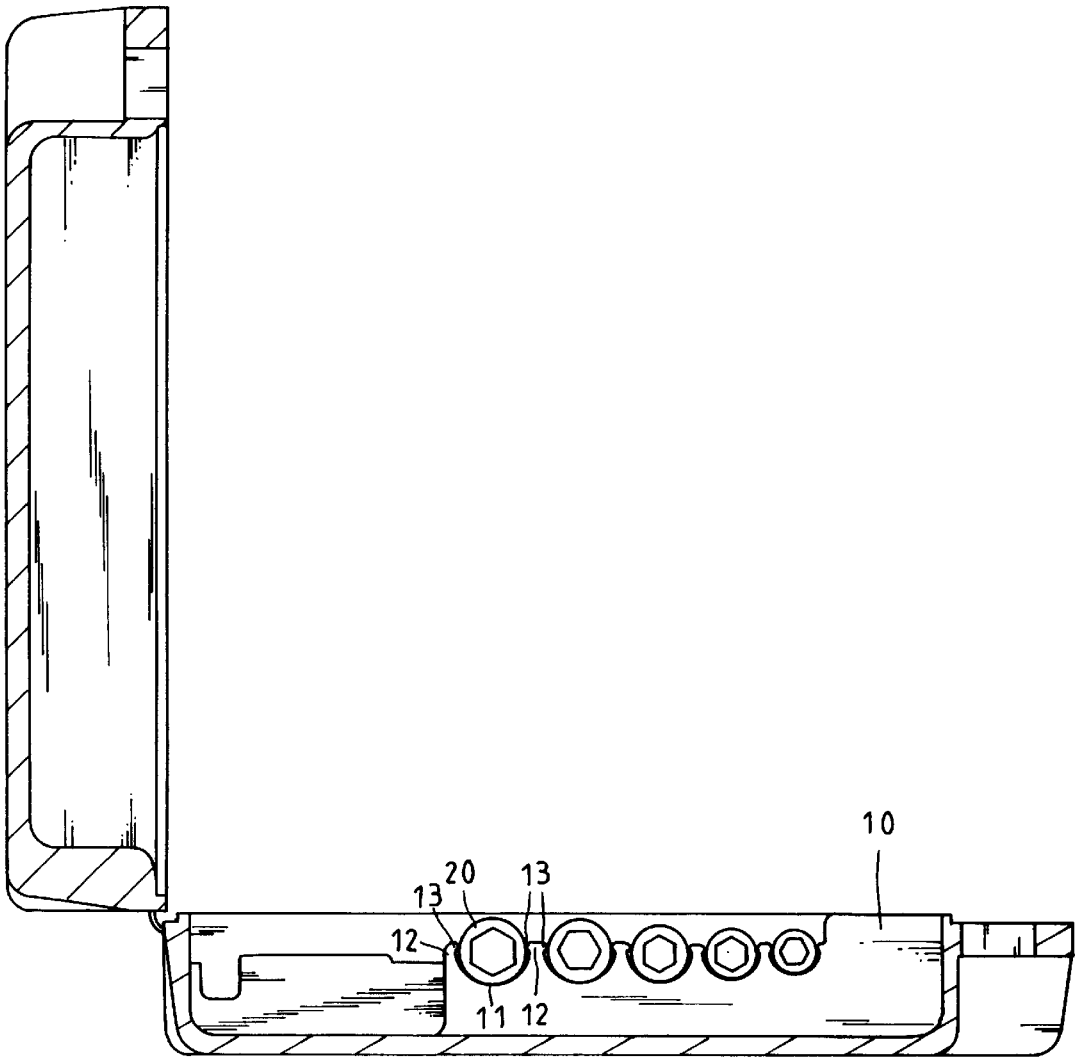
FIG. 2 PRIOR ART
FIG. 2 is a sectional view of a conventional tool box of the prior art.
Figure 3:
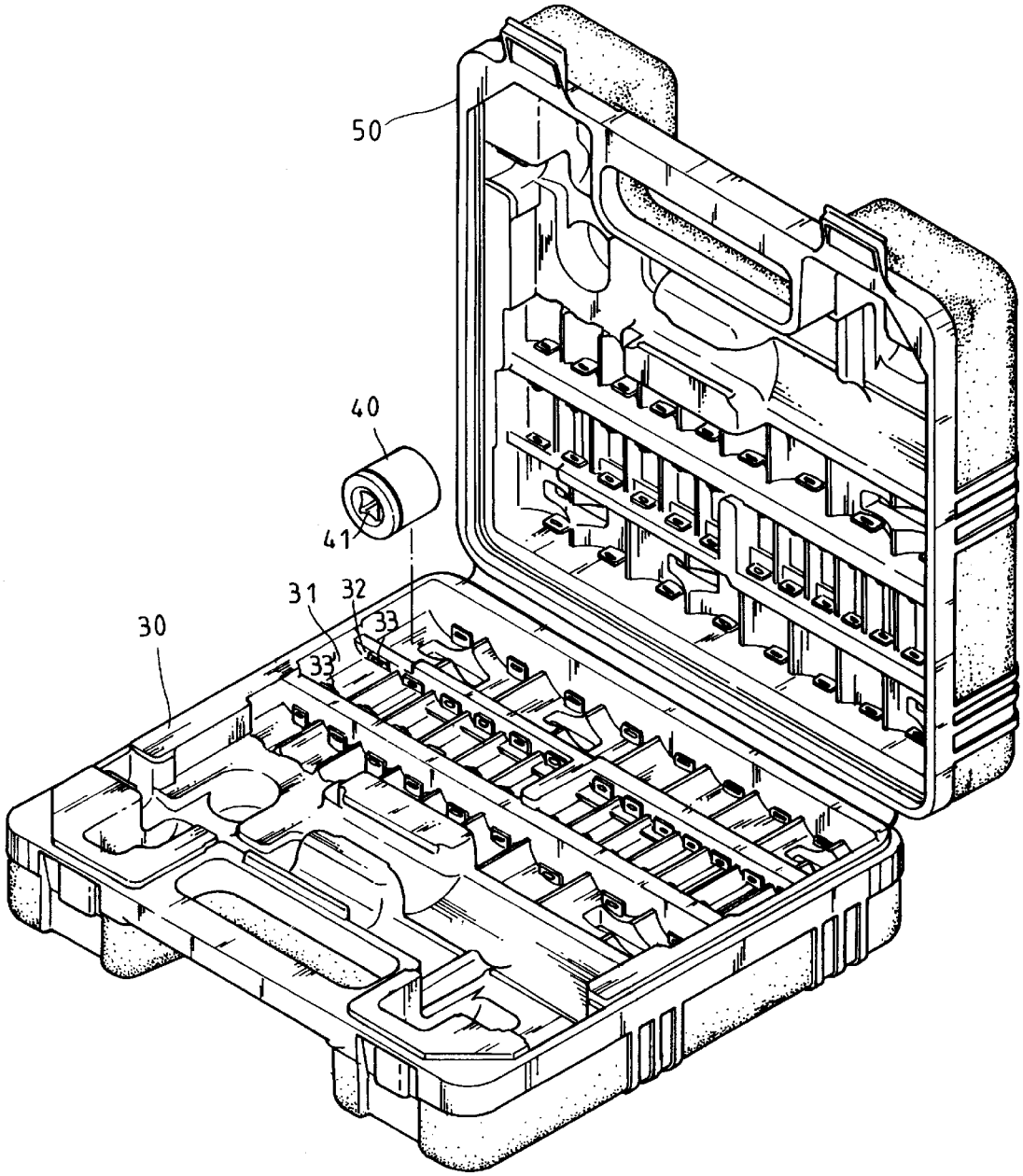
FIG. 3 is a perspective view of a tool box of a preferred embodiment in accordance with the present invention.
Figure 3A:
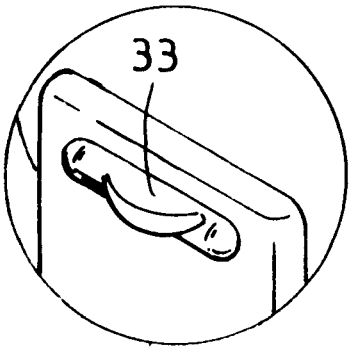
FIG. 3A is a perspective view of a click block of a preferred embodiment in accordance with the present invention.
Figure 3B:
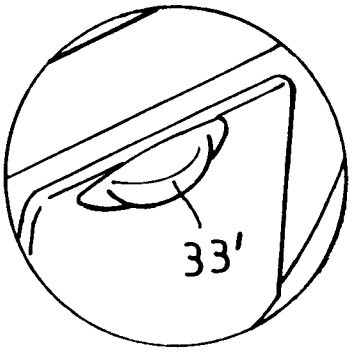
FIG. 3B is a perspective view of a click protrusion of a preferred embodiment in accordance with the present invention.
Figure 4:
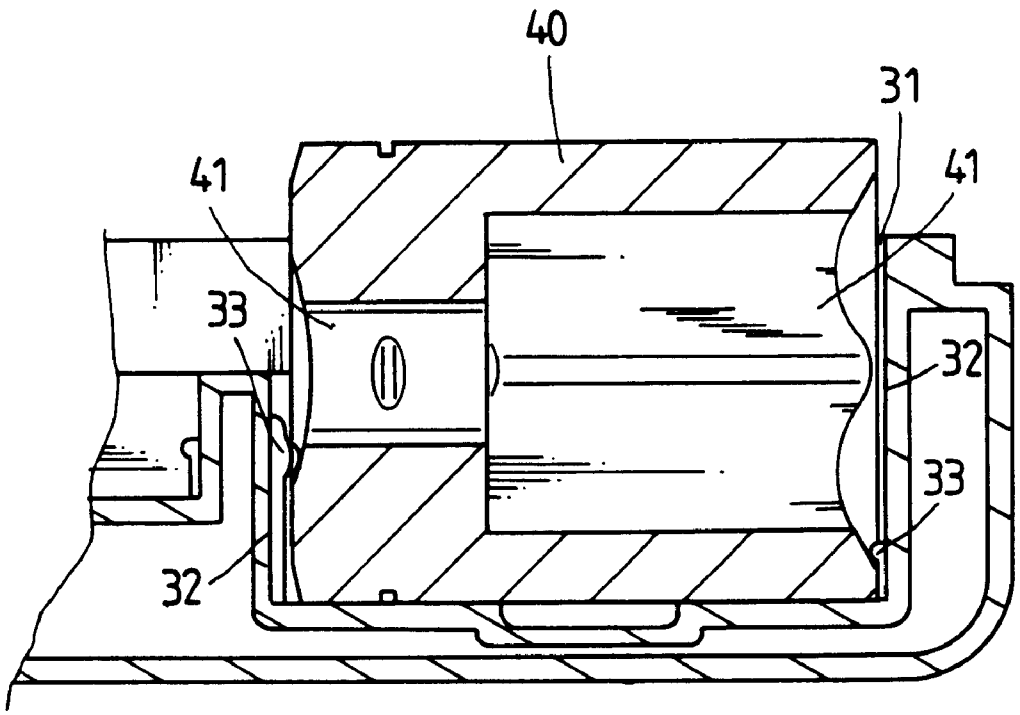
FIG. 4 is a partially sectional view of a tool box of a preferred embodiment in accordance with the present invention.
Figure 5:
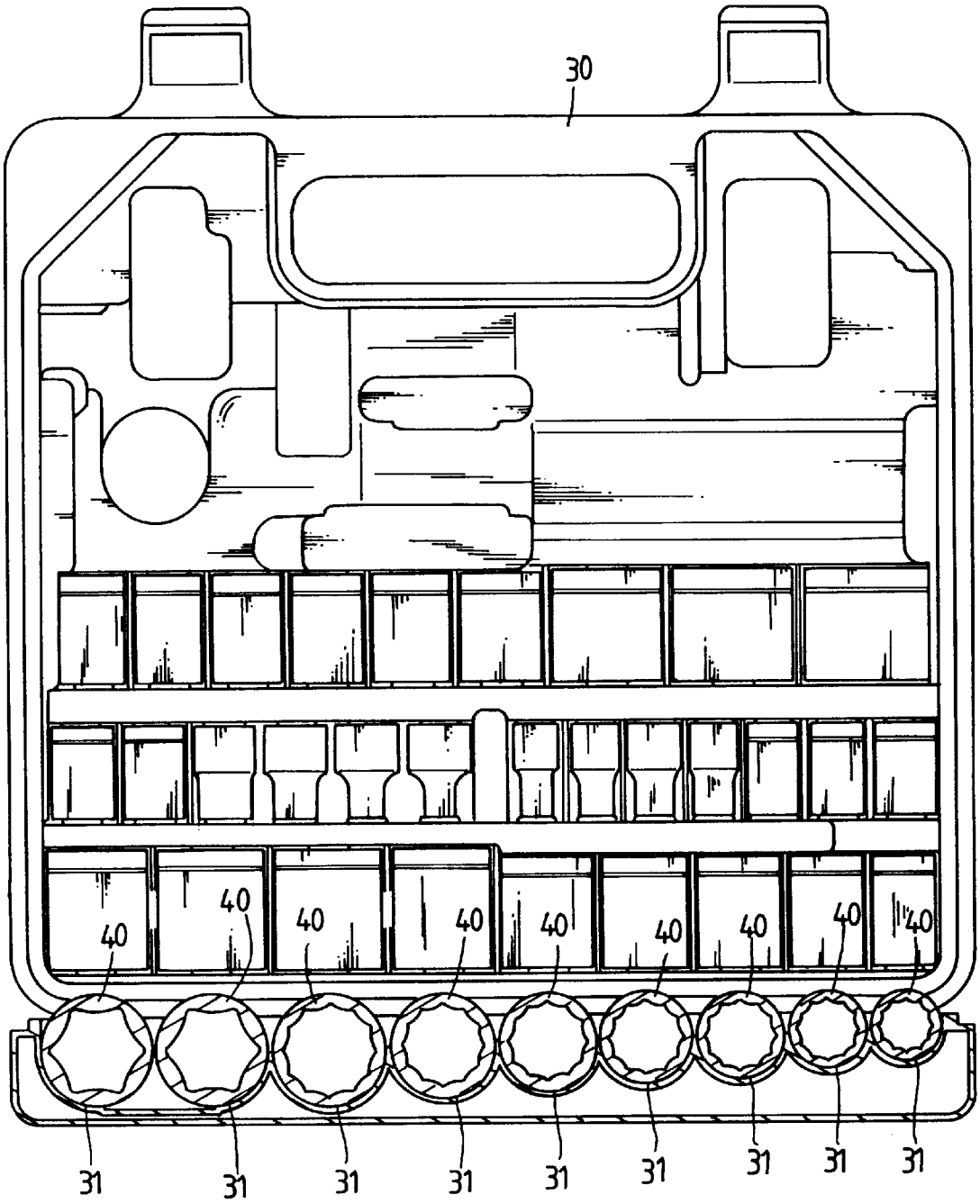
FIG. 5 is a scematic view illustrating a tool box of a preferred embodiment receiving a plurality of sleeves.

Referring to FIGS. 3 to 5, a tool box comprises a lower casing 30 and an upper casing 50 engaging with the lower casing 30.

The lower casing 30 comprises a plurality of separation plates 32, and at least a series of spaced grooves 31 defined between two of the separation plates 32. Each of the separation plates 32 has a plurality of click blocks 33 and a plurality of click protrusions 33'. A plurality of sleeves 40 are inserted in the spaced grooves 31. Each of the sleeves 40 has a center hole 41 engaging with the respective click block 33 and the respective click protrusion 33'.

The invention is not limited to the above embodiment but various modification thereof may be made. Further, various changes in form and detail may be made without departing from the scope of the invention.

I claim:

1. A tool box comprises:

a lower casing and an upper casing engaging with the lower casing, the lower casing comprising a plurality of separation plates, and at least a series of spaced grooves defined between two of the separation plates, and each of the separation plates having a plurality of click blocks and a plurality of click protrusions.

* * * * *